US005534396A

United States Patent [19]

McGuckin et al.

[11] Patent Number: 5,534,396

[45] Date of Patent: Jul. 9, 1996

[54] RINSE COMPOSITION FOR PHOTOGRAPHIC PAPER CONTAINING ALKYL ETHER SULFATE AND BIOCIDE, AND METHOD OF USE

[75] Inventors: Hugh G. McGuckin, Rochester; Jerel R. Carli, Penfield; John S. Badger, Webster; Stephen J. Waffle, Ontario, all of N.Y.

[73] Assignee: Eastman Kodak Company, Rochester, N.Y.

[21] Appl. No.: 336,431

[22] Filed: Nov. 9, 1994

[51] Int. Cl.[6] ..... G03C 5/39

[52] U.S. Cl. ..... 430/463; 430/372; 430/428; 430/429

[58] Field of Search ..... 430/372, 428, 430/429, 463

[56] References Cited

U.S. PATENT DOCUMENTS

| | | | |
|---|---|---|---|
| 4,778,746 | 10/1988 | Ishikawa et al. | 430/372 |
| 4,778,748 | 10/1988 | Kuse et al. | 430/428 |
| 4,800,153 | 1/1989 | Morimoto et al. | 430/372 |
| 4,980,272 | 12/1990 | Kuse et al. | 430/463 |
| 5,110,716 | 5/1992 | Kuse et al. | 430/429 |
| 5,169,743 | 12/1992 | Ishikawa | 430/372 |
| 5,254,444 | 10/1993 | Okada et al. | 430/491 |
| 5,296,338 | 3/1994 | Chester | 430/372 |

FOREIGN PATENT DOCUMENTS

| | | |
|---|---|---|
| 91/05289 | 4/1991 | European Pat. Off. . |
| 465228 | 1/1992 | European Pat. Off. . |
| 63/244036 | 10/1988 | Japan . |
| 4/25835 | 1/1992 | Japan . |

*Primary Examiner*—Hoa Van Le
*Attorney, Agent, or Firm*—J. Lanny Tucker

[57] ABSTRACT

A photographic rinse composition has been developed which reduces jamming in the processing of photographic print materials and prevents biological growth on and leaching of materials from the print materials. This composition includes a vinyl pyrrolidone polymer, at least about 0.02 g/l of a biocide mixture comprising 5-chloro-2-methyl-4-isothiazolin-3-one and 2-methyl-4-isothiazolin-3-one, and at least about 0.02 g/l of an alkyl ether sulfate surfactant. Cupric ion can also be included to stabilize the biocide mixture.

17 Claims, No Drawings

RINSE COMPOSITION FOR PHOTOGRAPHIC PAPER CONTAINING ALKYL ETHER SULFATE AND BIOCIDE, AND METHOD OF USE

FIELD OF THE INVENTION

This invention relates in general to photography, and more specifically it relates to the processing of color papers. In addition, it relates to a rinse composition which is used in the final step employed in the processing of photographic color papers.

BACKGROUND OF THE INVENTION

Photographic color papers (also known as color print materials) are generally processed in a series of processing steps which includes color developing, bleach-fixing and rinsing. The bleach-fix bath typically contains a thiosulfate-containing compound which functions as a fixing agent and forms a water-soluble silver thiosulfate complex. Following the bleach-fix step, the resulting photographic prints are treated with a rinse solution to remove unwanted thiosulfate complex and other unwanted residues of the prior processing steps. Those prints are then conveyed through a dryer where they are contacted with warm dry air.

Many different formulations have been proposed for use as a rinse solution in such processes. Generally, the rinse solution includes a biocide to control unwanted biological growth. It may also contain any of a variety of sequestering agents to retain calcium ion in solution, thereby avoiding precipitation of calcium salts which can foul processing apparatus and become deposited on the prints.

One potential problem in such processing methods is the precipitation of elemental sulfur or silver sulfide from the decomposition of silver thiosulfate complex generated in the bleach-fix step. Such precipitates are also highly undesirable.

It is also known to include in rinse solutions a vinyl pyrrolidone polymer, as described for example in U.S. Pat. No. 4,537,856 and Japanese Patent Publication 28945/86. These polymers are effective to reduce precipitation of elemental sulfur and silver sulfide. When such polymers are used alone, the surfaces of the photographic prints become tacky and can cause jamming in processing apparatus and dryers. This problem has been solved in part by incorporating a polysiloxane surfactant into the rinse solution, as described in WO 91/05289 (published Apr. 18, 1991).

While the problem with jamming has been solved to a considerable extent with the polysiloxane surfactant, it has been observed that the prints may still become tacky and materials can leach out of them and become deposited on transport rollers in the dryer section of the processing equipment. Thus, consistency in solving the noted problems has not always been achieved with the known rinse solutions. In addition, the polysiloxane surfactant is considered to be expensive and its replacement would be desirable.

Thus, there is a need to provide a process whereby prints can be subjected to final rinse solutions which perform all of the conventional functions but which also consistently alleviate the noted problems.

SUMMARY OF THE INVENTION

We have overcome the noted problems with a photographic paper rinse composition having a pH of from about 4 to about 9 and comprising:

a vinyl pyrrolidone polymer, at least about 0.02 g/l of a biocide mixture comprising 5-chloro-2-methyl-4-isothiazolin-3-one and 2-methyl-4-isothiazolin-3-one, and at least about 0.02 g/l of an alkyl ether sulfate surfactant.

This invention also provides a method for processing an imagewise exposed photographic paper. The method comprises, as a final bath treatment, contacting an imagewise exposed and fixed photographic paper with a rinse composition having the components as described above, but having a pH of from about 7 to about 9.

The present invention advantageously provides a means for consistent processing of color or black and white photographic prints with minimal risk of jamming because of print tackiness or formation of deposits on transport rollers in processing equipment. The usual concerns of biological growth and deposition of elemental sulfur and silver sulfide are also obviated. In addition, it has been found that the rinse composition of this invention can be readily concentrated for packaging and sale without undesired cloudiness or formation of precipitates.

All of these advantages are achieved by the particular ingredients and amounts in the rinse composition identified above. The presence of the biocide mixture, stabilized with cupric ion in the concentrate form, retards biological growth and makes it possible to readily form composition concentrates for packaging. In addition, the expensive nonionic polysiloxane of conventional rinse solutions has been replaced with a less expensive anionic surfactant which performs better in terms of reducing the formation of residues which cause paper jamming. Thus, polysiloxane surfactants are absent from the composition of this invention.

DETAILED DESCRIPTION OF THE INVENTION

The photographic paper rinse composition of this invention is an aqueous solution having a pH of from about 4 to about 9, and more preferably, a pH of from about 4 to about 6 when in concentrated form. The pH may be higher when the concentrate is diluted to working strength (preferably from 7 to 9) for use in the method of the invention.

A vinyl pyrrolidone polymer is present in the rinse composition of this invention. Polymers of vinyl pyrrolidone are well known, commercially available materials. Useful materials include the homopolymer of a vinyl pyrrolidone ethylenically unsaturated polymerizable monomer as well as various water-soluble or water-dispersible copolymers of a vinyl pyrrolidone and one or more other ethylenically unsaturated polymerizable monomers such as methyl acrylate, methyl methacrylate, ethyl acrylate, vinyl acetate, 4-vinylpyridine, N-acryloylmorpholine, N-acryloxypiperidine and others which would be readily apparent to one skilled in polymer chemistry. Obviously, a skilled artisan would know how to proportion the amounts of various monomers in the copolymers to achieve the desired hydrophilic properties. It is preferred that the copolymers comprise at least 50 mol percent of a vinyl pyrrolidone monomer, such as N-vinyl-2-pyrrolidone.

Generally, the vinyl pyrrolidone polymer used in the invention has a molecular weight in the range of from about 2,000 to about 150,000 and more preferably in the range of from about 5,000 to about 50,000. The most preferred polymer is poly(N-vinyl-2-pyrrolidone) having a molecular weight of about 15,000.

A second critical component of the composition of this invention is a biocide mixture of 5-chloro-2-methyl-4-isothiazolin-3-one and 2-methyl-4-isothiazolin-3-one, which are the primary ingredients of the product commercially known by the tradename Kathon LX. These thiazole compounds can be used in combination with other similar compounds which have a nitrogen atom and a sulfur atom in a 5-membered ring. Such compounds include, but are not limited to, 1,2-benzisothiazoline-3-one, 2-octyl-4-isothiazoline-3-one, 2-chloro-4-thiazolylbenzimidazole and others readily apparent to one skilled in the art.

It is preferred that the composition of this invention have 5-chloro-2-methyl-4-isothiazolin-3-one as the predominant thiazole, that is at least 50% (by weight) of the biocide mixture.

A third critical component of the composition of this invention is a water-soluble alkyl ether sulfate surfactant (or mixtures of two or more such surfactants). Such materials can be represented by the structure (I):

$$R—O—(—R'—O—)_n—SO_3M$$

wherein R is a branched or linear alkyl group of 6 to 14 carbon atoms (such as hexyl, heptyl, octyl, nonyl, decyl, dodecyl, 2-methyloctyl, 2,4-diethylhexyl and 3-methyldecyl), R' is ethylene, M is hydrogen, an alkali metal ion (such as lithium, sodium or potassium ion) or ammonium ion, and n is an integer of 2 to 20. By "alkyl group" is meant substituted or unsubstituted alkyl, with possible substituents being hydroxy, halo or any other group which does not inhibit the surfactant water-solubility or effect in the practice of this invention.

In structure (I), preferably, R is a branched or linear alkyl of 8 to 12 carbon atoms and R of 12 carbon atoms is most preferred. Also, n is preferably 2 to 12. M is preferably an alkali metal ion, such as sodium ion.

The compounds represented by structure (I) can be prepared using conventional starting materials or purchased from a number of commercial sources. For example, preferred compounds are commercially available from Witco Corp. as WITCOLATE™ SE-5, WITCOLATE™ ES-2, WITCOLATE™ ES-3 or WITCOLATE™ LES 60C. These anionic surfactant solutions are aqueous solutions of lauryl ether sulfate. Other materials are described by tradename and commercial source in *McCutcheon's Volume* 1: Emulsifiers & Detergents, 1993 North American Edition, McCutcheon Division, MC Publishing Co., Glen Rock, N.J., pages 294–295 ("Sulfates of Ethosylated Alcohols").

An optional, but highly preferred component of the composition, is a source of cupric ion. Generally, cupric ion is present in the form of a salt having either organic or inorganic anions. Any cupric salt can be used which is inert to materials in the photographic papers being processed and to other components in the rinse composition. Such salts include, but are not limited to, the nitrates, acetates and sulfates, and are readily available from a number of commercial sources. Cupric nitrate is most preferred in the practice of this invention.

The cupric ion is particularly essential for stabilizing the biocide compounds when the composition is in a concentrated form. When the composition is diluted for use in processing photographic materials, the presence of the cupric ion is less critical, but still beneficial for stabilizing the biocide.

The materials in the rinse composition of this invention are present in particular amounts which provide the desired results described above. A source of cupric ion is present in such an amount as to provide at least about 0.3 parts per million (ppm) of cupric ion, with from about 1 to about 4 ppm of cupric ion being preferred.

The vinyl pyrrolidone polymer is present in amounts readily apparent to one skilled in the art. Generally it is present in an amount of at least about 0.1 g/l, and preferably from about 0.1 to about 2 g/l, with from about 0.1 to about 1 g/l being more preferred.

At least about 0.02 g/l of the noted mixture of thiazoles is present, with from about 0.04 to about 0.08 g/l being preferred. The surfactant is present in an amount of at least about 0.02 g/l, with from about 0.04 to about 0.2 g/l being preferred.

As used in this application, the modifier "about" refers to ±0.5 unit when defining pH, and refers to ±10% of the indicated values when defining amounts of compounds or mixtures.

The components of the rinse composition can be mixed together in any suitable order as would be known in the art, and can additionally contain any number of useful addenda including, but not limited to, buffers and sequestering agents, which would be known to one skilled in the art.

The rinse composition of this invention is especially useful as the final bath treatment of imagewise exposed photographic paper materials. More particularly, it can be used after the development, bleaching, fixing (or bleach-fixing) and optional stabilizing of photographic color print materials. In addition, it can be used as the final rinse in the processing of imagewise exposed and fixed black and white photographic papers.

Such photographic color and black and white print materials and the various steps used to process them are well known and described in a considerable number of publications, including, for example, Research Disclosure No. 36544, published September, 1994 (pages 501–541), and references cited therein. Research Disclosure is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). The invention can be practiced with photographic elements containing any of many varied types of silver halide emulsions including all types of silver halide crystal morphology, sensitizers, color couplers, and addenda known in the art, as disclosed in the noted *Research Disclosure* publication and references cited therein. The elements can be composed of any number of layers and have any of the known types of supports, including supports having magnetic backing.

Thus, color developing agents are well known and widely used in a variety of color photographic processes, and include aminophenols and p-phenylenediamines. Color developing solutions can include a number of other components including, but not limited to, high pH buffers, strong bases, halides, benzyl alcohol, antioxidants, antifoggants, solubilizing agents and brighteners.

Bleaching, fixing or bleach-fixing solutions are also well known and include bleaching agents and fixing agents in combination or individually. Common bleaching agents include ferric complexes of aminopolycarboxylic acids. Fixing agents include thiosulfates, but other fixing agents are likewise known.

The rinse composition of this invention is particularly useful in the processing of reflection print materials having a resin-coated photographic paper support, and especially in the rapid access processing of such materials. Further details of processing are provided in the *Research Publication* citation noted above. Rapid access processing of reflection print materials is described in some detail in WO 87/04534 (published Jul. 30, 1987).

The composition of this invention can be formulated as a concentrated or diluted solution. It can also be formulated in dry or tablet form which is then dissolved in a buffer or water for use.

Practice of the present invention is illustrated by the following examples, but the present invention is not to be construed as so limited. All percentages are by weight unless otherwise indicated.

Materials and Methods for Examples

PVP K-15 poly(N-vinyl-2-pyrrolidone) was obtained from GAF at 30% solids in an aqueous solution.

Kathon LX (containing 14% total of 2-methyl-4-isothiazolin-3-one and 5-chloro-2-methyl-4-isothiazolin-3-one) was obtained from Rohm & Haas.

WICOLATE™ SE-5, ES-2, ES-3, LES 60c and ES370 anionic surfactants were obtained from Witco Corp.

The remaining materials were obtained from Eastman Kodak Company or other commercial sources.

EXAMPLE 1

Rinse Composition

A composition of this invention (Example 1) was prepared by mixing PVP K-15 polymer (30%, 140 g/l), Kathon LX (14%, 72.5 g/l), WITCOLATE™ SE-5 anionic surfactant (60%, 16.7 g/l) and water (797.2 ml). The unadjusted pH of this concentrated composition was measured at 4.58.

A Control composition was similarly prepared without the WITCOLATE™ SE-5 anionic surfactant. It was observed that it become cloudy and a precipitate formed after two weeks storage at 21° C.

EXAMPLE 2

Processing of Color Photographic Prints

The concentrated composition of Example 1 was diluted with tap water (6 ml of concentrate to 1 liter total volume) in order to prepare a working strength solution for a final bath treatment (identified as Formula I) for imagewise-exposed, developed and bleach-fixed color photographic prints. Formula I had a pH of about 7.5.

The processing procedure was as follows:

KODAK EKTACOLOR™ 2001 Paper was processed in a KODAK SYSTEM™ 20 Paper Processor using KODAK EKTACOLOR™ RA Developer Replenisher, KODAK EKTACOLOR™ RA Bleach-Fix and Replenisher and Formula I. The racks and tanks in the rinsing section of the processing equipment were cleaned prior to use. Formula I was premixed and added to the appropriate tanks in the processor. Formula I was replenished during processing at the rate of 23 ml/ft$^2$ (248 ml/m$^2$). Countercurrent flow of the rinse composition was used in four adjacent rinse tanks.

Over a period of about 1 month, 20,000 color photographic prints were processed using Formula I, the racks and dryer rollers were then examined, and the seventh roller on the down side of the dryer was removed for evaluation. There was no indication of residue on the dryer rollers or tank surfaces for the method of this invention. There also was no indication of solids in the rinse solution in the tanks resulting from biological growth. Such growth was monitored periodically throughout the processing method of this invention using a membrane filter plating test and a nutrient medium. Good control of biological growth was evident because less than 10 colony forming units/ml (CFU/ml) were observed after 20,000 color prints were processed.

A similar process was carried out using a Control rinse composition containing a conventional vinyl pyrrolidone polymer, a silicone-based surfactant and a benzisothiazole biocide. A noticeable residue was present on the dryer transport rollers after processing 20,000 color prints. This residue is undesirable because it can cause prints to stick to the transport rollers, resulting in jamming and machine damage. Severe biological growth was observed throughout the entire Control process (the measurements ranged from $10^5$ to $10^8$ CFU/ml).

EXAMPLE 3

Stabilized Concentrated Composition

A preferred concentrated composition of this invention was prepared similarly to that of Example 1 except that cupric nitrate, 2.5 hydrate (1 g/l) was also added.

The presence of the cupric ion provided stability at elevated temperature (32° C.), whereas the concentrated composition lacking the cupric ion showed increasing degradation of the biocide after 1, 2, 3 and 4 months, as measured by high pressure liquid chromatography. In contrast, the stabilized composition showed little degradation of the biocide over the same period. A 42% loss of the chloro-substituted thiazole was measured after storage for months at 32° C. without the presence of the cupric ion in the concentrate. With the cupric ion present, the measured loss was only 1% under the same conditions.

EXAMPLE 4

Processing-Method Using Stabilized Composition

The composition of Example 3 was used to process photographic color prints. It was diluted (6 ml to 1 liter with tap water) to prepare a solution of working strength (Formula II).

The photographic elements were developed and processed as described in Example 2 except the following processors were used:

Machine A: KODAK™ CREATE-A-PRINT™ 35 mm ENLARGEMENT CENTER™

Machine B: NORITSU™ 1202

Machine C: NORITSU™ 1202.

Formula II was replenished in these machines at the rate of 23 ml/ft$^2$ (248 ml/m$^2$). Countercurrent flow of rinse was utilized in each processor.

There was no indication of residue on the rollers or tank surfaces after over 20,000 color prints were processed with each processor.

Biological growth was monitored throughout each experiment. The results are shown in Tables I, II and III for the processor machines A, B and C, respectively. Good control of biological growth was evident with all of the processors.

TABLE I

| Days After Test Start | Bacteria Level (CFU/ml) Tank 1 | Tank 2 |
|---|---|---|
| — | 10 | <10 |
| 7 | <10 | <10 |
| 14 | <10 | <10 |
| 21 | <10 | <10 |
| 36 | <10 | <10 |
| 43 | <10 | <10 |
| 50 | <10 | <10 |
| 64 | <10 | <10 |
| 78 | <10 | <10 |

TABLE II

| Days After Test Start | Bacteria Level (CFU/ml) Tank 1 | Tank 2 | Tank 3 | Tank 4 |
|---|---|---|---|---|
| — | 30 | <10 | <10 | 20 |
| 7 | <10 | <10 | <10 | <10 |
| 14 | $2.6 \times 10^{-3}$ | <10 | <10 | <10 |
| 21 | $1.1 \times 10^{-4}$ | <10 | <10 | <10 |

TABLE III

| Days After Test Start | Bacteria Level (CFU/ml) Tank 1 | Tank 2 | Tank 3 | Tank 4 |
|---|---|---|---|---|
| — | <10 | 10 | <10 | <10 |
| 5 | <10 | 150 | <10 | <10 |
| 7 | <10 | 300 | 20 | <10 |
| 12 | <10 | 340 | 10 | <10 |

EXAMPLE 5

Processing Method Using Various Surfactants

The compositions of Example 1 and 3 were evaluated for the effect of the surfactant included therein. It was observed that the surfactant helped stabilize the concentrated composition by preventing the formation of precipitates.

When similar compositions were prepared without the surfactant at room temperature, the compositions became cloudy and a precipitate was observed after storage for two weeks at 21° C. The compositions were free of precipitate in the presence of the surfactant after storage for 1 month at 48° C.

Other surfactants, namely WITCOLATE™ ES-2, WITCOLATE™ ES-3, WITCOLATE™ LES 60c and WITCOLATE™ ES370 were similarly evaluated, and showed similar stabilizing effects in the concentrated compositions of this invention.

The invention has been described in detail with particular reference to preferred embodiments thereof, but it will be understood that variations and modifications can be effected within the spirit and scope of the invention.

We claim:

1. A photographic paper rinse composition having a pH of from about 4 to about 9 and comprising:

a vinyl pyrrolidone polymer, at least about 0.02 g/l of a biocide mixture comprising 5-chloro-2-methyl-4-isothiazolin-3-one and 2-methyl-4-isothiazoline-3-one, a source of at least about 0.3 ppm cupric ion, and at least about 0.02 g/l of an alkyl ether sulfate surfactant having the structure (I);

$$R—O—(—R'—O—)_n—O_3M$$

wherein R is a branched or linear alkyl group of 6 to 14 carbon atoms, R' is wthylene, M is hydrogen, an alkali metal or ammonium ion, and n is 2 to 20.

2. The rinse composition of claim 1 wherein said source of cupric ion is cupric nitrate present in an amount sufficient to supply from about 1 to about 4 ppm of cupric ion.

3. The rinse composition of claim 1 wherein said vinyl pyrrolidone polymer is present in an amount of from about 0.1 to about 2 g/l.

4. The rinse composition of claim 1 wherein said vinyl pyrrolidone polymer is poly(N-vinyl-2-pyrrolidone).

5. The rinse composition of claim 1 wherein said biocide mixture is present in an amount of from about 0.04 to about 0.08 g/l.

6. The rinse composition of claim 1 wherein said surfactant is present in an amount of from about 0.04 to about 0.2 g/l.

7. The rinse composition of claim 1 wherein R is a branched or linear alkyl of 8 to 12 carbon atoms, M is an alkali metal and n is 2 to 12.

8. The rinse composition of claim 1 wherein said surfactant is lauryl ether sulfate.

9. The rinse composition of claim 1 having a pH of from about 4 to about 6.

10. The rinse composition of claim 1 having a pH of from about 7 to about 9.

11. A method for processing an imagewise exposed photographic paper, said method comprising:

as a final bath treatment, contacting an imagewise exposed and fixed photographic paper with a rinse composition having a pH of from about 7 to about 9 and comprising:

a vinyl pyrrolidone polymer, at least about 0.02 g/l of a biocide mixture comprising 5-chloro-2-methyl-4-isothiazolin-3-one and 2-methyl-4-isothiazoline-3-one, a source of at least about 0.3 ppm cupric ion, and at least about 0.02 g/l of an alkyl ether sulfate surfactant having the structure (I):

$$R—O—(—R'—O—)_n—SO_3M$$

wherein R is a branched or linear alkyl group of 6 to 14 carbon atoms, R' is ethylene, M is hydrogen, an alkali metal or ammonium ion, and n is 2 to 20.

12. The method of claim 11 wherein said vinyl pyrrolidone polymer is present in an amount of from about 0.1 to about 2 g/l.

13. The method of claim 11 wherein said biocide mixture is present in an amount of from about 0.04 to about 0.08 g/l.

14. The method of claim 11 wherein said surfactant is present in an amount of from about 0.04 to about 0.2 g/l.

15. The method of claim 11 for wherein said processed photographic element is an imagewise exposed, developed, bleached and fixed photographic color paper.

16. The method of claim 11 wherein said biocide mixture comprises at least 50%, by weight, of 5-chloro-2-methyl-4-isothiazolin-3-one.

17. A method for processing an imagewise exposed photographic paper, said method comprising:

as a final bath treatment, contacting an imagewise exposed and fixed photographic paper with a rinse composition having a pH of from about 7 to about 9 and consisting essentially of:

a vinyl pyrrolidone polymer, at least about 0.02 g/l of a biocide mixture comprising 5-chloro-2-methyl-4-isothiazolin-3-one and 2-methyl-4-isothiazoline-3-one, a source of at least about 0.3 ppm cupric ion, and at least about 0.02 g/l of an alkyl ether sulfate surfactant having the structure (I):

$$R—O—(—R'—O—)_n—SO_3M$$

wherein R is a branched or linear alkyl group of 6 to 14 carbon atoms, R' is ethylene, M is hydrogen, an alkali metal or ammonium ion, and n is 2 to 20.

* * * * *

UNITED STATES PATENT AND TRADEMARK OFFICE

CERTIFICATE OF CORRECTION

PATENT NO. : 5,534,396

DATED : July 9, 1996

INVENTOR(S) : Hugh G. McGuckin et al.

It is certified that error appears in the above-indentified patent and that said Letters Patent is hereby corrected as shown below:

Col 8, line 5 delete [R-O-(-R'-O-)$_n$-O$_3$M] and insert therefor -- R-O-(-R'-O-)$_n$-SO$_3$M --

Col 8, line 8 delete [wthylene] and insert therefor -- ethylene --.

Signed and Sealed this

Twenty-second Day of October, 1996

*Attest:*

*Attesting Officer*

BRUCE LEHMAN

*Commissioner of Patents and Trademarks*